United States Patent [19]

Pritt

[11] 4,309,831

[45] Jan. 12, 1982

[54] FLEXIBLE ATHLETIC SHOE

[76] Inventor: Donald S. Pritt, 4542 Emerson Ave., Rte. #2 North, Parkersburg, W. Va. 26101

[21] Appl. No.: 115,043

[22] Filed: Jan. 24, 1980

[51] Int. Cl.[3] ..... A43B 7/06; A43B 13/04

[52] U.S. Cl. ..... 36/3 B; 36/32 R

[58] Field of Search ..... 36/3 R, 3 B, 32 R, 129, 36/59 R, 135

[56] References Cited

U.S. PATENT DOCUMENTS

| | | | |
|---|---|---|---|
| 1,891,021 | 12/1932 | Burdotti | 36/3 A |
| 2,930,149 | 3/1960 | Hack et al. | 36/32 R |
| 3,020,654 | 2/1962 | McCann | 36/135 |
| 3,475,836 | 11/1969 | Brahm | 36/3 B |
| 3,507,059 | 4/1970 | Vietas | 36/32 R |
| 3,785,646 | 1/1974 | Ruskin | 36/32 R |
| 3,932,950 | 1/1976 | Taber | 36/32 R |

FOREIGN PATENT DOCUMENTS

| | | | |
|---|---|---|---|
| 2809011 | 8/1979 | Fed. Rep. of Germany | 36/3 B |
| 1522007 | 4/1968 | France | 36/3 B |

*Primary Examiner*—Patrick D. Lawson
*Attorney, Agent, or Firm*—John E. Benoit

[57] ABSTRACT

A shoe is provided including a standard upper and a sole, with the sole comprising a base extending from the toe of the shoe to the heel of the shoe with a plurality of cleats subtending from the sole. The forward edge of the cleats subtends from the sole rearwardly at a predetermined angle from the vertical of the basic sole surface. Preferably, the rearward edge of the cleat is substantially flat. This provides an action whereby, when the wearer is running, the foot will strike the ground and the cleats will bend backward allowing the foot to continue its forward motion until it reaches a more gradual stop than normally occurs in any other running shoe. Additionally, there is provided a means for continually venting a shoe while it is being worn, and which may be used with the above described shoe or independently in other shoes.

4 Claims, 15 Drawing Figures

21
13
17
4.
4.
15
25
27
23
3.
3.
11
19
φ

17
15

FLEXIBLE ATHLETIC SHOE

The present invention relates generally to athletic shoes and more specifically to athletic shoes which have a flexible shoe action, particularly when the person wearing the shoe is running.

All athletic shoes in use today are primarily identical as far as the action of the foot within the shoe. Various sole gripping designs have been used for various purposes such as for running or jogging. However, while the various designs may have varying cushion effects and relative gripping tendencies for different surfaces, they do not primarily affect the movement of the foot within the shoe. When an athlete is running, his foot comes down on the ball and has a tendency to continue forward movement. However, the normal athletic shoe stops almost instantaneously and forces the foot itself to slide within the shoe. Such a sudden stop causes a definite strain on the foot of the wearer, and, in time, often results in foot damage and resultant pain.

Many factors contribute, in a rather complex way, to the very individual feeling of comfort when running. But no single factor determines the comfort and efficient usage of a running shoe more than its sole. Shoe tops can be made of nylon, leather or mesh, the substance does not much matter. But the material from which the shoe sole is made matters a great deal and is the source of the greatest difference of opinion among runners and joggers.

The sole is the support mechanism for carrying weight to the ground during running. Two soles affect the support characteristics of the shoe. The outer sole affects shoe flexibility and the midsole gives forefoot cushioning.

The outer sole has been shaped into several different patterns, some for functional purposes, but mostly for aesthetic purposes. The outer sole flared into a daring quantity of extra material on the shoe bottom is one of those which appeal to the eye. It was a faddish trend used by manufacturers which has now been discarded because the additional rubber only added weight. For the last couple of years, outer sole tread in the form of waffles have been manufactured. The design is not particularly advantageous, while it does no harm.

One of the vital considerations is the sole composition, since it provides flexibility or rigidity. The sole should ideally allow a great amount of flexibility at the point on the foot where it naturally flexes. Such location is directly behind the toes, and this is the major problem with modern running shoes. They are made of either crepe, or rubber, or neoprene, and the sole grabs the running surface, especially if it is flat and hard. The soles do not flex with the result that, when the shoe comes down on the floor, the sole takes hold and forces the foot to slide inside. Friction and heat are manufactured wholesale. The tissues are rubbed between the nonflexing interior of the shoe and the firm, unyielding bones. The soft tissues are abused.

Inflamed metatarsal heads, metatarsalgia, tendonitis, myositis, bursitis, neuromas, callous formation, dorsal corns on the toes, joint inflammation, and other problems occur. The foot is generally irritated because the rubber-type material on the outsole does not flex. Thickness in the outer sole gives a platform effect and detracts from the stability and efficiency of the shoe and the foot. There should be good relationships between flexibility and cushioning, but this is hardly ever the case in available shoes.

Cushioning comes from the midsole where the construction is also supposed to be of a rather flexible material. This is not to be in modern running shoes since the midsole is usually stiff. Extreme stiffness, necessary to be avoided, is frequently built into the interior so that the midsole gives the runner a feeling of firmness. He really knows he is wearing a pair of shoes, but what he fails to realize is that the midsole is frictionizing his heels, toes, inner longitudinal arches, and anterior metatarsal arches. He is playing havoc with the tender soft tissues, the collagen fibers and elastin connecting together muscles to tendons and ligaments to bones. The relationship between flexibility and cushioning has been lost. The result must terminate finally in lower leg injuries such as shin splints and tendonitis. In the following table, there are listed the injuries to the feet and legs that occur from too inflexible an outer sole and midsole.

TABLE I

Injuries to Feet and Legs from Inflexible Shoe Soles

| | Injury | Duration of Convalescense |
|---|---|---|
| 1. | Blister: Separation of skin layers by fluids | Insignificant problem but location may be troublesome |
| 2. | Bursitis: Inflamed fluid protective sac | A few days |
| 3. | Contusion or Bruise: Damage to Blood vessels beneath skin surface | Insignificant to a few days |
| 4. | Dislocation: Bone separation at joint | 2 to 4 weeks |
| 5. | Complete Fracture: Bone Break | 6 to 8 weeks (or more) |
| 6. | Stress Fracture: Bone Crack | 6 to 8 weeks |
| 7. | Neuritis: Pinched Nerve | Days to weeks with slow recovery |
| 8. | Periostitis: Bone Bruise | Days to a few weeks |
| 9. | Skin Calluses: Skin thickening for protection | Insignificant |
| 10. | Sprain: Torn Ligament | Days to weeks |
| 11. | Strain: Torn Tendon or muscle | Days to weeks |
| 12. | Subungual Hematoma: Blood clot under toenail | A couple of days at the most |
| 13. | Tendonitis: Inflammation of the tendon sheath and, in extreme cases, calcification of the sheath. | Discomfort on uphill run or upon sprinting |

As mentioned previously, the flared outsole serves little or no functional purpose and may be dangerous to those runners who have an extremely abducted gait. The tendency is to actually cut the skin of the calves from swinging the foot forward on the opposite side. The outflare sole cuts like a knife.

Outer sole tread is not necessary, either. It can fit the individual runner's preference if he thinks the treaded sole gives him more lift and bounce. The waffle tread and ripple sole seem better when used on dirt and grass. The shoes with transverse treads may be more desirable for running on asphalt streets. In any case, one can get along fine with just a flat sole.

The inner sole probably would be less of a source of friction if manufacturers used a Spenco material as the shock absorber. Spenco is known to limit blistering, while cloth inner soles tend to irritate. Besides, cloth absorbs foot perspiration excessively leaving the tissues to swim in a pool of sweat. This is the breeding ground for microbes to grow on the skin. No inner sole material should soak up moisture like a sponge, because the foot will always be wet, and the shoes may not dry out from one wearing to the next.

Other insole materials have been tried that are just as impractical. Nylon, for instance, retains heat and moisture inside the shoe and can cause blistering.

Shoe weight is a factor, as well, and may be determined by the outer sole substance. The lighter the shoe, the greater the chance of injury but the more flexibility it has. The heavier the shoe, the more protection, but the more rigidity it has. The individual runner must decide on his or her priorities. For training purposes, a heavy shoe may be preferable to a light shoe, especially if the runner is going for high mileage. Protection is the choice over speed.

Running the marathon for the first time will require a training shoe. Twenty-six plus miles places a great deal of pressure on the feet and legs not used to the minimal protection that a racing flat provides. But then there arises the inflexible sole again.

Accordingly, it is an object of the present invention to provide an athletic shoe which is unique in the sole structure so that the foot of the person wearing the shoe will have some degree of freedom of movement in a forward direction after the shoe has contacted the running surface.

It is a further object of the present invention to provide various cleat configurations for an athletic shoe which relieve the normal substantially instantaneous halting of the movement of the foot when the shoe strikes the surface.

Another object of this invention is to provide a means for continually venting the shoe while it is in use.

These and other objects of the invention will become apparent from the following description taken in conjunction with the drawings.

Broadly, the present invention provides a shoe including a standard upper and a sole, with the sole comprising a base extending from the toe of the shoe to the heel of the shoe with a plurality of cleats subtending from the sole. The forward edge of the cleats subtends from the sole rearwardly at a predetermined angle from the vertical of the basic sole surface. Preferably, the rearward edge of the cleat is substantially flat. This provides an action whereby, when the wearer is running, the foot will strike the ground and the cleats will bend backward allowing the foot to continue its forward motion until it reaches a more gradual stop than normally occurs in any other running shoe. Additionally, the invention provides a means for continually venting a shoe while it is being worn, and which may be used with the above described shoe or independently in other shoes.

Figure 1:
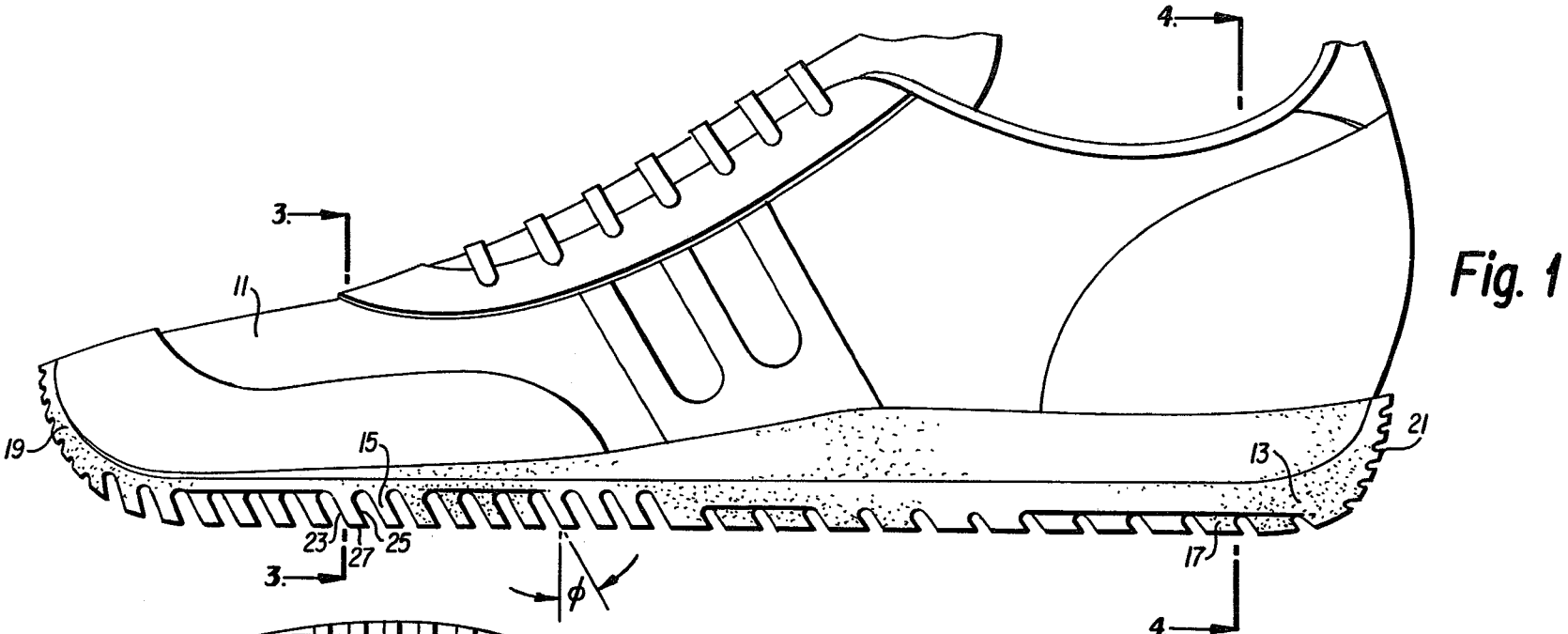
FIG. 1 is a side elevational view of one embodiment of a shoe of the present invention.
Figure 2:
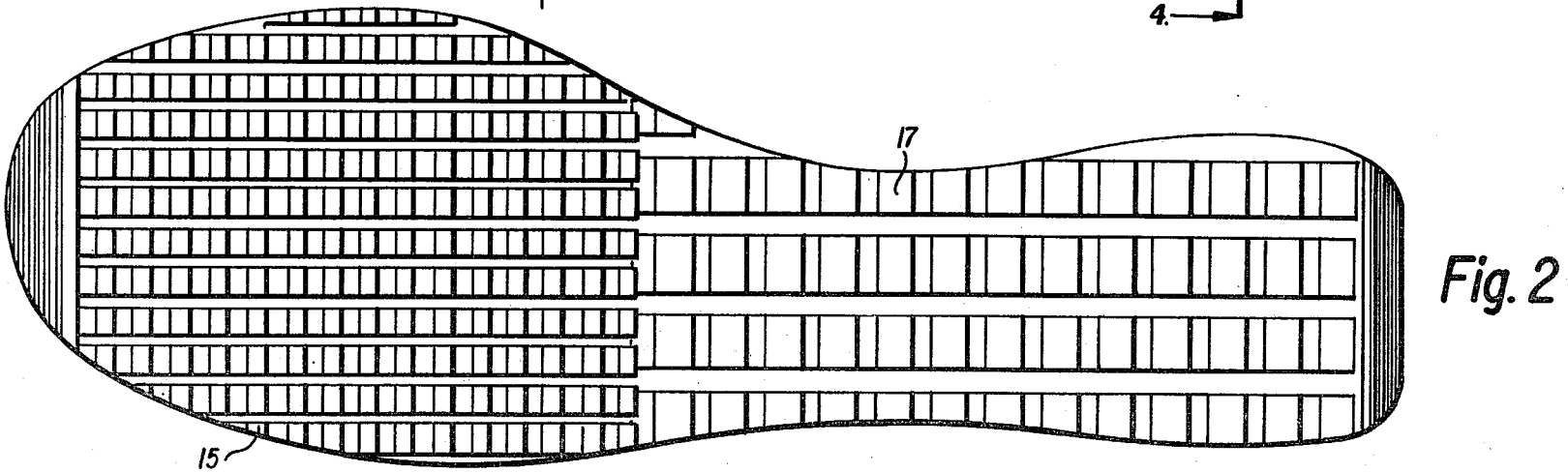
FIG. 2 is a bottom view of the shoe of FIG. 1.

Turning now more specifically to the drawings, there is shown in FIGS. 1 and 2 one embodiment of a shoe of the present invention. The shoe has the standard upper normally used in any athletic shoe together with a sole 13 which extends from the toe of the shoe to the heel of the shoe. This sole includes downwardly subtending forward cleats 15 of a predetermined dimension size and downwardly subtending rearwardly cleats 17 also of a predetermined size. As can be seen in this configuration, the entire sole 13 includes the above-described cleats and may also include smaller cleats extending about the upper end of the toe and likewise rearwardly about the upper end of the heel.

An essential part of this invention lies in the fact that the individual cleats subtend at an angle $\phi$ from a vertical line extending at right angles downwardly from the base of the sole. In the shoe as shown in FIGS. 1 and 2, this angle $\phi$ is less than 45° and greater than 10°. Preferably, this angle is between 10° and 45°, and in the preferred embodiment the angle is between 20° and 45°.

Figure 4:
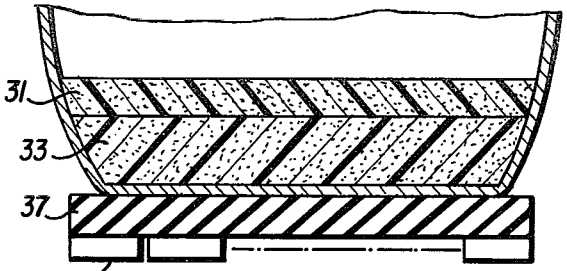
FIG. 4 is a sectional view taken through line 4—4 of FIG. 1.
Figure 3:
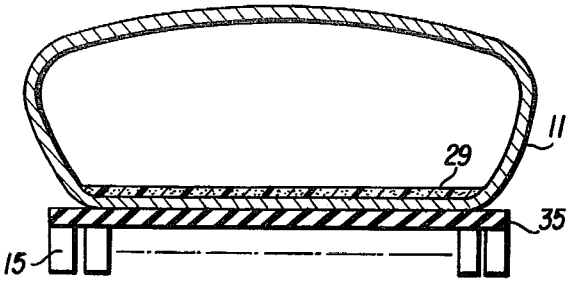
FIG. 3 is a sectional view taken through line 3—3 of FIG. 1.

FIGS. 3 and 4 illustrate the interior construction of the basic show which is applicable to the shoe of FIGS. 1 and 2 and to the other embodiments to be described hereinbelow. A midsole 29 extends rearwardly and increases in depth so as to form the rear cushion midsole 31. At the rear of the shoe, midsole 31 is supported by an arch support 33. The shoe also includes an outer forward sole 35 which extends rearwardly and also increases in depth to form the outer rear sole 37. The cleats 15 and 17 described above subtend from the outer sole.

Figure 5:
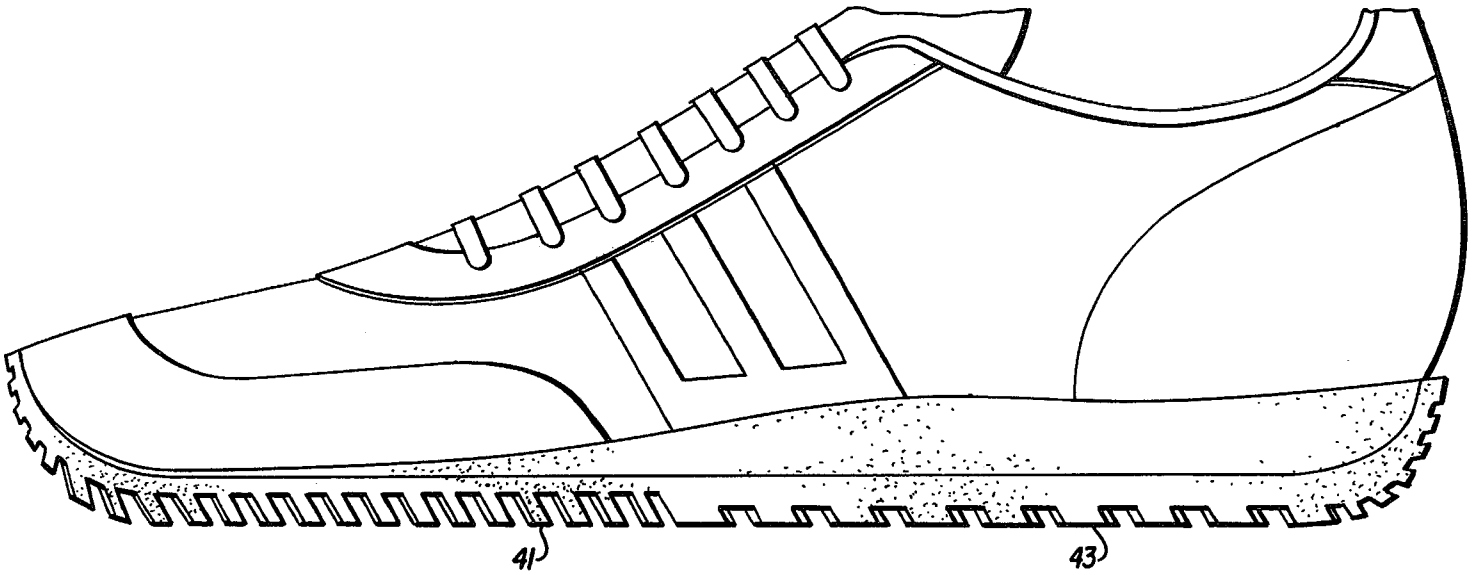
FIG. 5 is a side elevational view of a modification of a shoe of FIG. 1.
Figure 6:
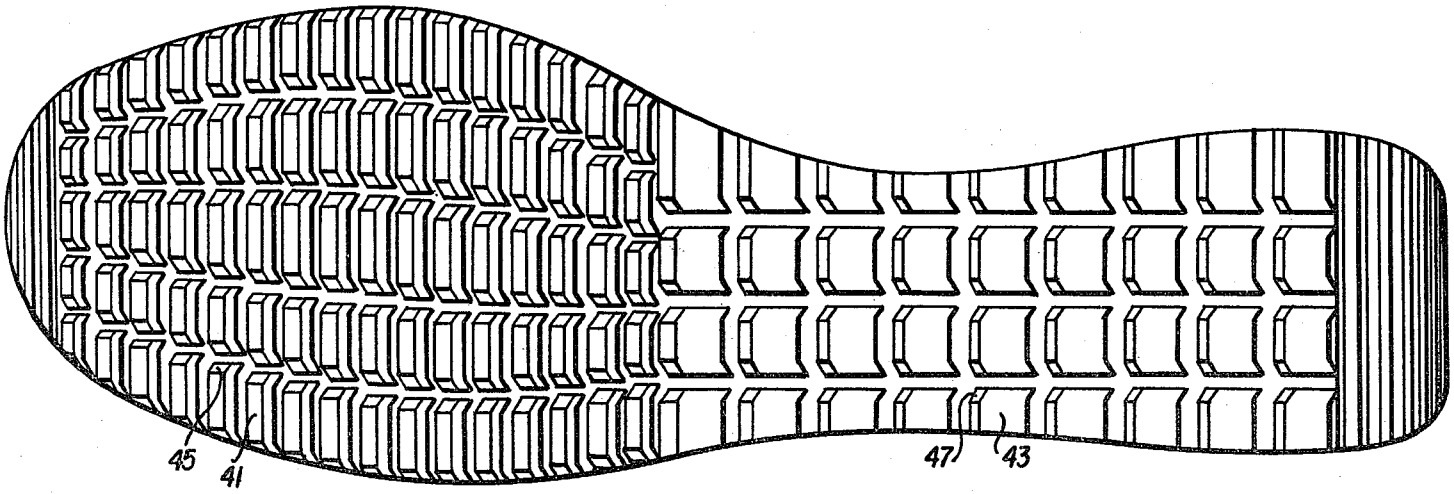
FIG. 6 is a bottom view of a shoe of FIG. 5.

FIGS. 5 and 6 disclose a modification of the shoe of FIGS. 1 and 2. In this modification, the cleats 41 and 43 subtend at an angle similar to that discussed above, but are of such a design that they have beveled edges 45 and 47 respectively. This type of shoe may be more desirable for a walking action while the shoe of FIGS. 1 and 2 is designed to be primarily for jogging and running shoes.

Figure 7:
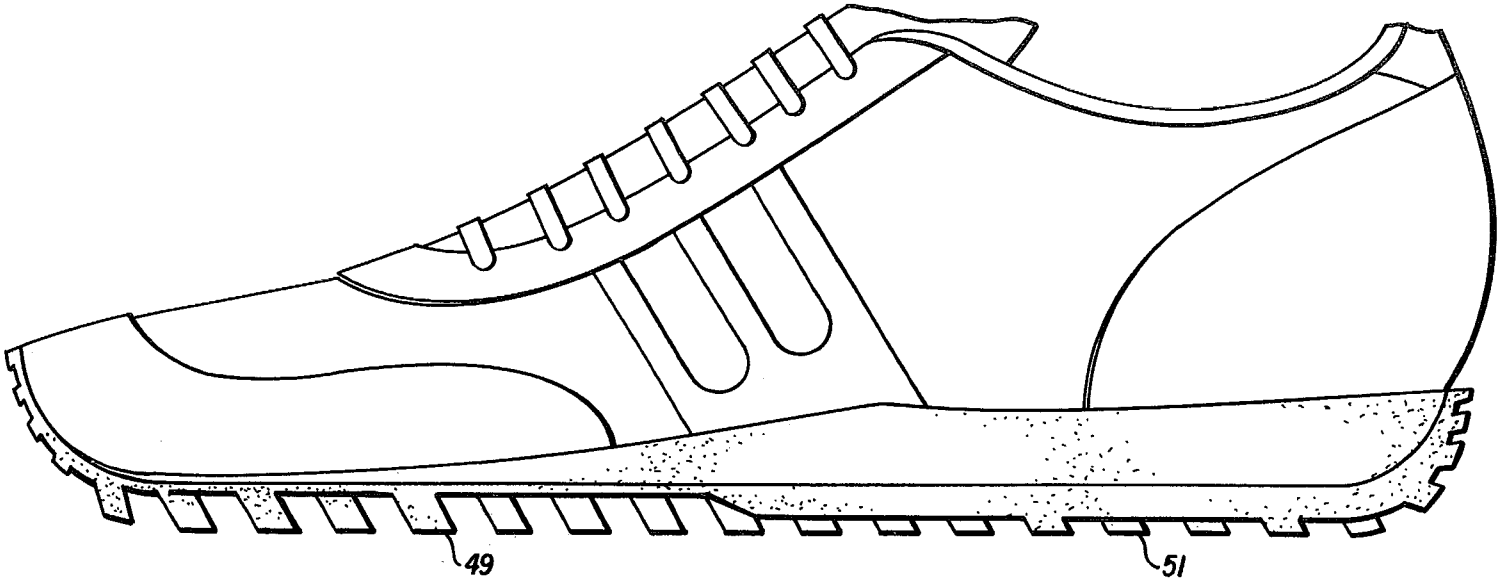
FIG. 7 is an illustration of a further modification of the shoe of FIG. 1.
Figure 8:
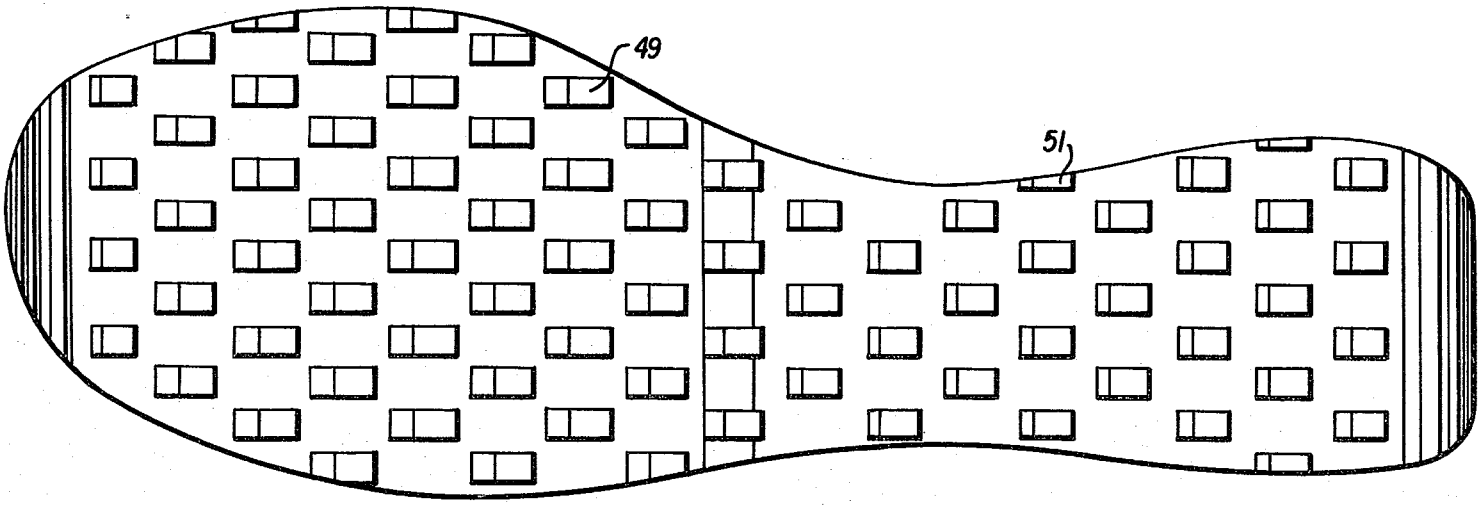
FIG. 8 is a bottom view of the shoe of FIG. 7.

Yet a further modification of the shoe of FIG. 1 is shown in FIGS. 7 and 8. Again, the cleats of the shoe subtend rearwardly at an angle as described hereinabove. However, the forward cleats are substantially square in cross section as are rearward cleats 51. The rearward cleats in this particular modification are shorter and subtend from a heavier sole section at the rear of the shoe. This shoe is primarily designed as a walking shoe.

Figure 9:
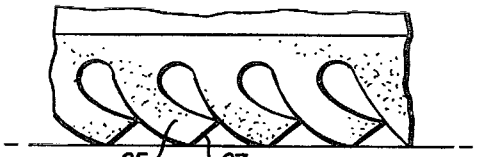
FIG. 9 is a partial elevational view of the sole of the shoe of FIG. 1 illustrating the configuration occurring during use.

FIG. 9 is a partial side elevational view of the forward part of the shoe of FIG. 1, and illustrative of the other configurations described herein showing the effect that occurs as a result of the runner placing his weight upon the shoe. As can be seen, cleats 25 bend rearwardly so that a part of the face 27 of the cleat contacts the cleat immediately behind. This particular action is the essential part of the invention which allows the inner part of the shoe to move forward with the foot, thus eliminating substantially the movement or sliding of the foot within the shoe. It should be noted that the configuration of the cleats extending angularly to the rear of the shoe should be continued throughout the whole sole of the shoe. This is preferred since tests have indicated that at least 70% of those who jog or run daily contact the ground with their heels first. Thus, the action as shown in FIG. 9, is desirable throughout the entire length of the shoe.

Figure 10:
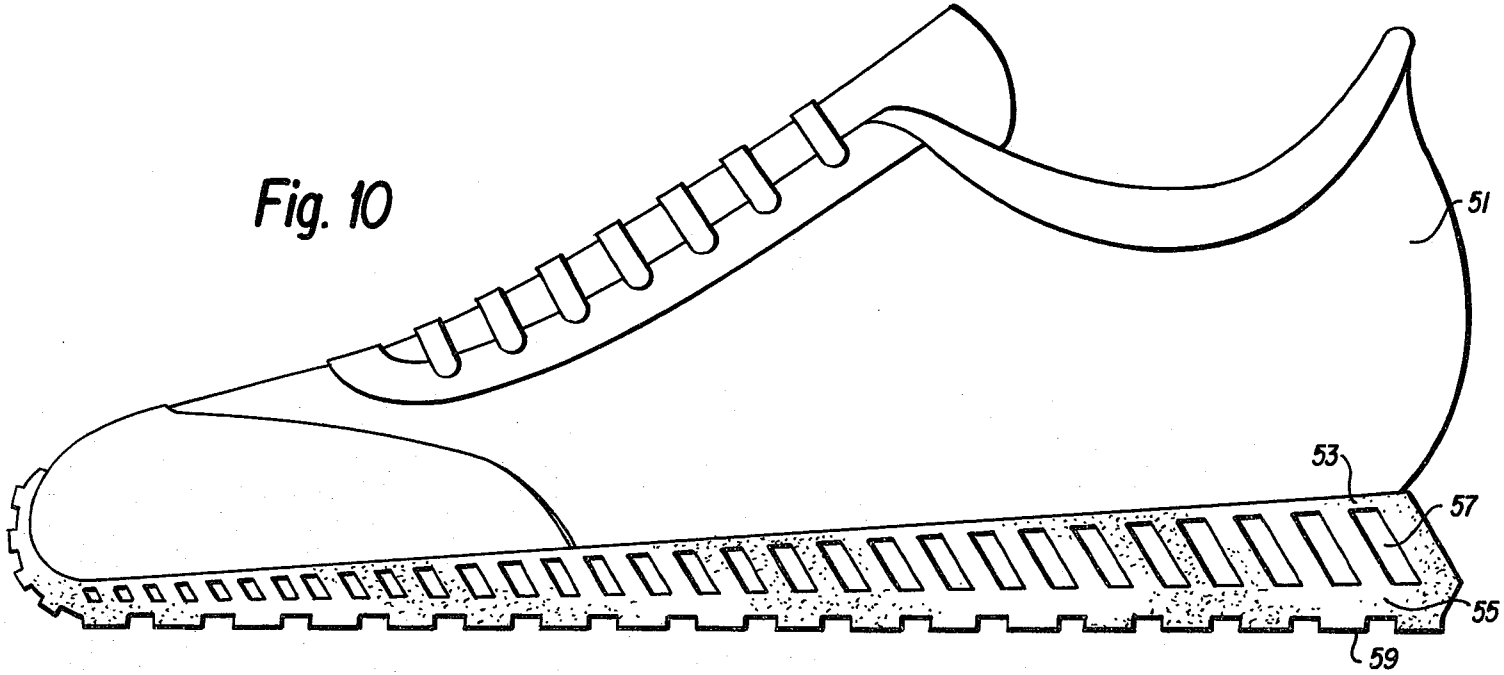
FIG. 10 is a side elevational view of a further modification of the shoe of the present invention.

FIG. 10 shows a modification of the shoe described relative to the other figures wherein the upper 51 is connected to an intermediate sole member 53 which effectively has the same cleat type construction depending rearwardly therefrom. However, in the configuration as shown in FIG. 10, the outer sole 55 is conformed so as to terminate at the end of each of the cleats so as to form a solid base while having air spaces 57 therebetween. When this configuration is used, standard cleats 59 may be used subtending from the outer sole 55. The action of the shoe shown in FIG. 10 is substantially the same as that described hereinabove with the exception that a solid surface contacts the ground.

FIGS. 11 through 15 illustrate a system whereby ventilation may be continually provided within the shoe while it is being worn. Such ventilation may be used in conjunction with the shoe described hereinabove or with other types of foot wear.

Figure 11:
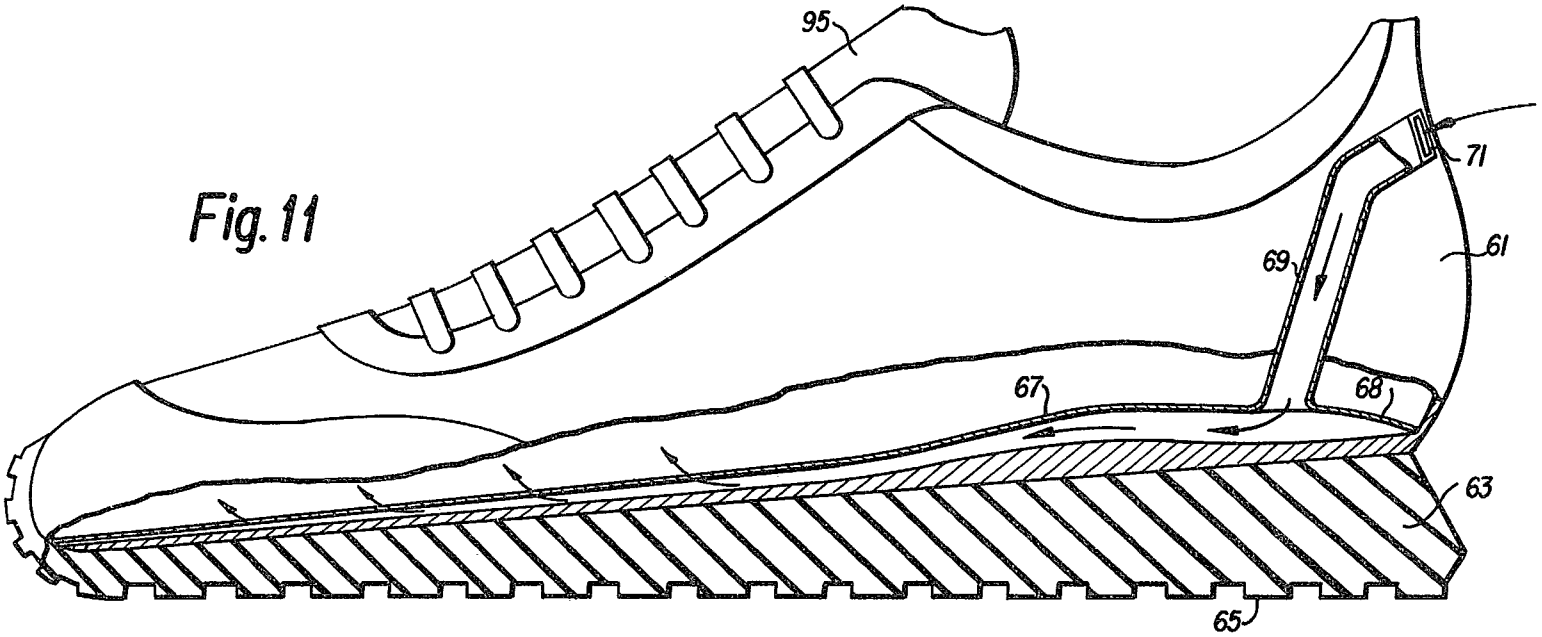
FIG. 11 is a side elevational view of the ventilation system which may be used in the shoe of the present invention.

FIG. 11 illustrates the use of the air ventilation system with a standard type running shoe having an upper 61 an outer 63 and cleats 65. Within the shoe there is secured a diaphragm 67 extending across the entire bottom of the shoe from the toe substantially to the heel portion. The diaphragm forms effectively a closed container with the exception of perforations appearing in the forward part thereof. Such perforations 73 are shown more clearly in FIG. 12. An air passage 69 extends from between the diaphragm 67 and the inner sole adjacent the outer part of the diaphragm at the heel end of the shoe and extends upwardly and outwardly through the upper and terminates in an air intake 71. The rear section 68 of diaphragm 67 is tapered sharply downwardly so as to terminate at the rear of the heel section.

As the runner comes down on the heel, the air enclosed by the diaphragm 67 is forced forwardly along the insole of the shoe and passes upwardly through perforations 73. As the runner moves forward so as to rock onto the ball of his foot, air is taken in through via air intake 71 and passage way 69 to refill the area enclosed by the diaphragm 67. This cycle continues as the runner proceeds.

Figure 12:
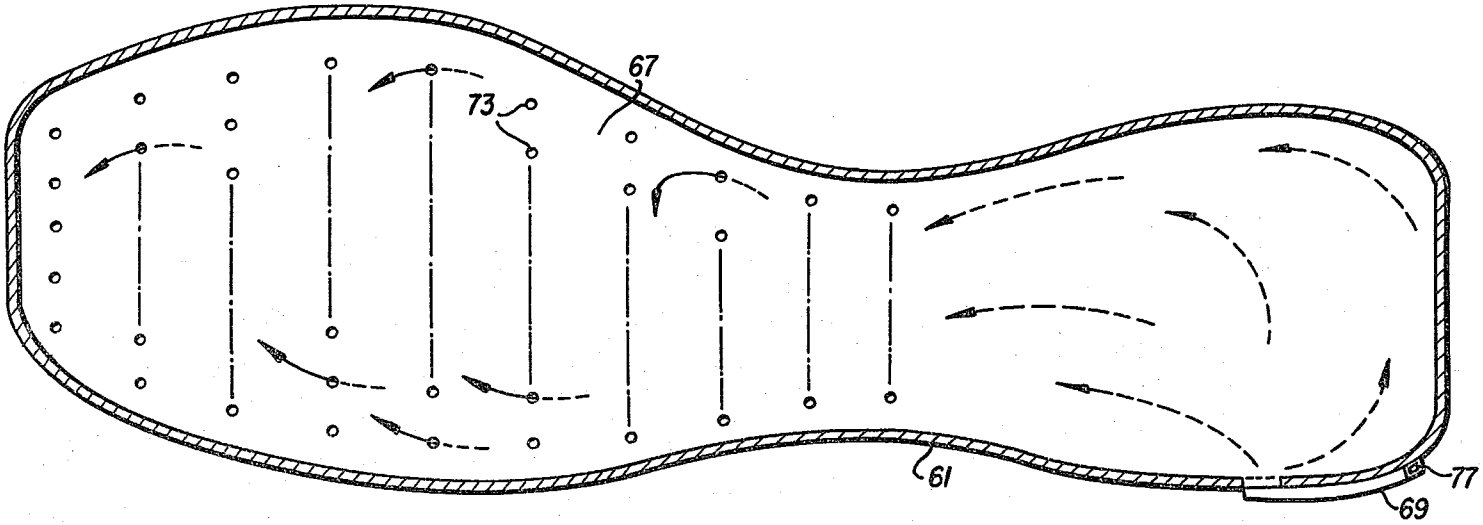
FIG. 12 is a plan view of the inner diaphragm used in FIG. 11.
Figure 14:
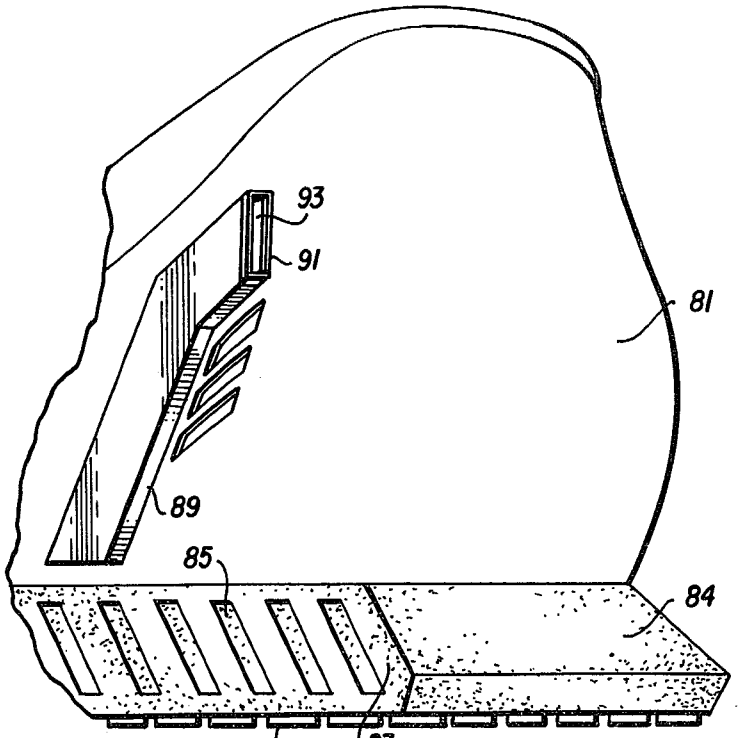
FIG. 14 is a partial side view illustrating the air tube.
Figure 15:
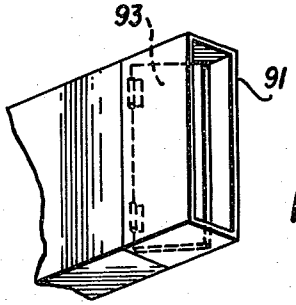
FIG. 15 is a enlarged view of the air tube opening and valve associated therewith.
Figure 13:
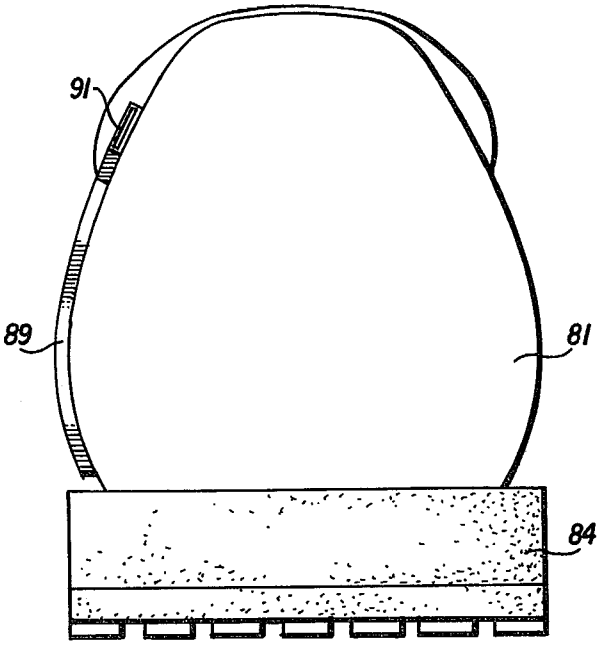
FIG. 13 is a rear view illustrating the air tube used for ventilation.

FIGS. 13 and 14 illustrate the use of the device of FIGS. 11 and 12 in a shoe of the type described relative to FIG. 10. This shoe has an upper 81, a sole 83 having air spaces 85 in the forward part of the shoe and terminates in a solid heel portion 84. Cleats 87 subtend from the bottom of sole 83. Air passage 89 terminates in an airtake 91. Additionally, in this modification, there is shown a one way valve 93 which is shown more explicity in the enlarged view shown in FIG. 15. The one way valve assists in preventing air from passing backwardly up through air passage 87 as the heel comes down, thereby insuring that the air will pass through the perforations within the diaphragm. If desired, the tongue of the shoe 95, (FIG. 11) may also include a plurality of perforations so as to allow the air to easily pass upwardly and outwardly from the shoe while it is being used.

The above described invention provides a new concept for the sole of a running shoe as well as a means for ventilating the shoe while it is being used. The description of the drawings are illustrative only since variations and configurations could be changed without departing from the scope of the invention which is to be limited only by the following claims.

I claim:

1. In a shoe including an upper and a sole, said sole comprising a base extending from the toe of said shoe to the heel of said shoe;

a plurality of cleats subtending from said sole;

the central axis of each of said cleats being at an angle between 10° and 45° subtending rearwardly from said base; and a second sole integrally attached to the terminal ends of said cleats.

2. The shoe of claim 1 further comprising a flexible diaphragm secured within said shoe a predetermined distance above the inner surface of said sole; said diaphragm substantially covering said inner surface;

perforations through said diaphragm; and an air passage connected at the heel area of said shoe between said diaphragm and said inner sole and extending outwardly through said upper.

3. The shoe of claim 2 further comprising a perforated tongue attached to said upper.

4. The shoe of claim 2 further comprising a one way valve in said air passage adjacent said upper.

* * * * *